United States Patent [19]

Gecewicz et al.

[11] 4,151,957

[45] May 1, 1979

[54] SHOWER SPRAY APPARATUS

[75] Inventors: Norbert A. Gecewicz, Schiller Park, Ill.; Tim M. Uydea, South San Gabriel, Calif.

[73] Assignee: Beatrice Foods Co., Chicago, Ill.

[21] Appl. No.: 763,817

[22] Filed: Jan. 31, 1977

[51] Int. Cl.[2] ..... B05B 1/08; B05B 1/16

[52] U.S. Cl. ..... 239/381; 239/438; 239/447; 239/530; 239/562; 239/574

[58] Field of Search ..... 128/66; 239/101, 102, 239/383, 438, 443, 446–449, 460, 525, 530, 562, 569, 574, 588, 381

[56] References Cited

U.S. PATENT DOCUMENTS

| | | | |
|---|---|---|---|
| 3,722,800 | 3/1973 | Shames et al. | 239/447 |
| 3,801,019 | 4/1974 | Trenary et al. | 239/102 X |
| 3,967,783 | 7/1976 | Halsted et al. | 239/102 |

FOREIGN PATENT DOCUMENTS

| | | | |
|---|---|---|---|
| 2324077 | 11/1974 | Fed. Rep. of Germany | 239/446 |
| 2451715 | 5/1976 | Fed. Rep. of Germany | 239/562 |

*Primary Examiner*—Evon C. Blunk
*Assistant Examiner*—Andres Kashnikow
*Attorney, Agent, or Firm*—Vogel, Dithmar, Stotland, Stratman & Levy

[57] ABSTRACT

The present invention relates generally to a hand held shower spray apparatus, and more particularly, to a hand held shower spray apparatus including a metering device to adjust the flow rate of water therethrough and apparatus which is selectively adjustable to provide a pulsating spray, a normal spray or a combination thereof.

8 Claims, 14 Drawing Figures

SHOWER SPRAY APPARATUS

BACKGROUND OF THE INVENTION

For some time, it has been known that a pulsating stream of water has a pleasant effect on a bather and shower spray apparatus with pulsating spray outlets are available. There are, however, other times in which it is desirable to have normal spray in a shower. In certain types of known apparatus the pulsating spray shower head is not adaptable to provide a non-pulsating spray while in other apparatus such as that disclosed in U.S. Pat. No. 3,967,783, issued July 6, 1976 to Halsted and Uyeda, the disclosure of which is incorporated herein by reference, there is disclosed apparatus for utilizing both normal spray and pulsating spray. In the Halsted et al. device the normal spray is emitted from different apertures than the pulsating spray and in some cases it is desirable from the bathers point of view to receive both sprays from a central location in the shower head face.

In many devices it is not possible to vary or control the volume of water entering the spray head and therefore either the normal spray or the pulsating spray may have too forceful an effect for the user. Other users desiring a very forceful effect have no adjustment capabilities. The present invention overcomes both these disadvantages of the prior art by providing both the normal spray and a pulsating spray mechanisms in the center of the shower head and providing mechanism for controlling the volume of water entering the shower head.

SUMMARY OF THE INVENTION

This invention relates to a hand-held spray apparatus and more particularly to a spray apparatus including mechanism for emitting both a normal spray and a pulsating spray located centrally of the shower head. This invention also relates to spray apparatus including a metering mechanism for controlling the flow rate of water to the shower head.

It is a general object of the present invention to provide a hand-held spray apparatus in which there is provided mechanism for controlling the flow rate of water to the shower head and mechanism for emitting either or both normal spray and pulsating spray from the center of the shower head.

It is another object of the present invention to provide a hand-held spray apparatus comprising a shower head housing having a handle connected thereto in fluid communication therewith adapted for connection to a source of pressurized water, the handle having an opening therein for conducting water from the source thereof to the shower head housing, a valve mounted in the handle for selectively communicating pressurized water from the source thereof to the shower head housing to permit the user to regulate the flow rate of water entering the shower head housing.

Another object of the present invention is to provide a hand-held spray apparatus comprising a hollow shower head housing having a handle connected thereto in fluid communication therewith and a front wall forming a chamber, the handle being adapted for connection to a source of pressurized water, a pulsating spray generator slidably positioned within the housing having an inlet and an outlet, the periphery of the outlet end forming with the front wall a plurality of spray outlets, and slide valve means interconnecting the inlet end of the pulsating spray generator and the handle and the hollow shower head housing for selectively communicating pressurized water from the handle to the housing chamber, the pulsating spray generator or proportionately therebetween.

A still further object of the present invention is to provide a hand-held spray apparatus of the type set forth in which both the water flow rate metering device and the single control opening accommodating both pulsating spray mechanism and shower spray mechanism is provided.

These and other objects of the present invention will be more apparent by reference to the following description taken in conjunction with the drawings, in which:

DESCRIPTION OF A PREFERRED EMBODIMENT

Figure 1:
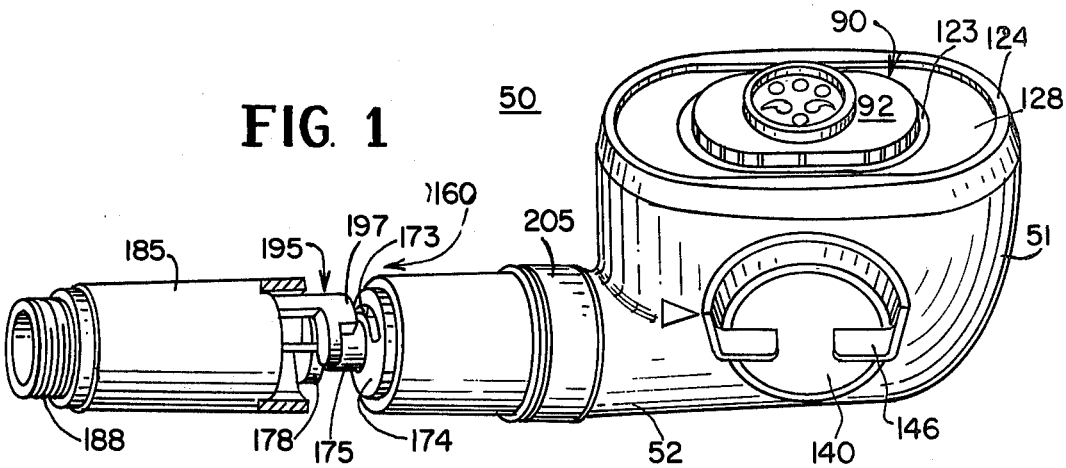
FIG. 1 is a perspective view of the hand-held spray apparatus of the present invention with the handle partly broken away particularly illustrating the metering device.
Figure 2:
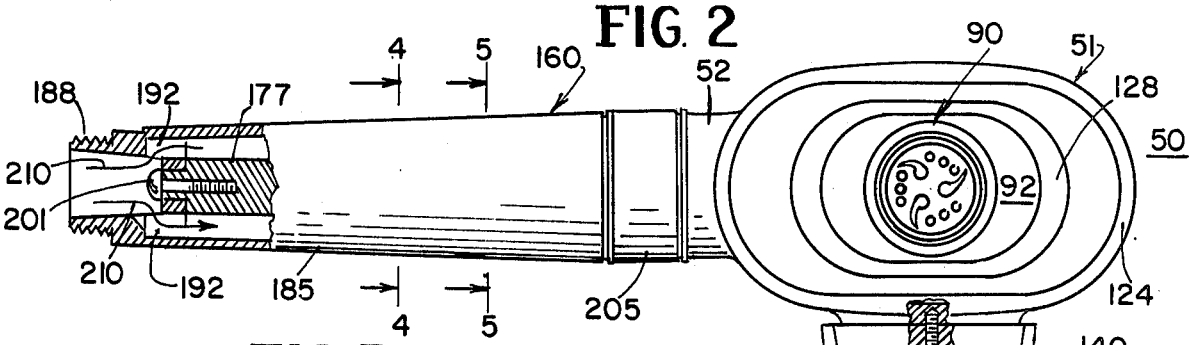
FIG. 2 is a top plan view of the device illustrated in FIG. 1 with the handle end partly broken away particularly illustrating the water flow path entrance to the spray apparatus and the mounting of the adjustment knob.
Figure 3:
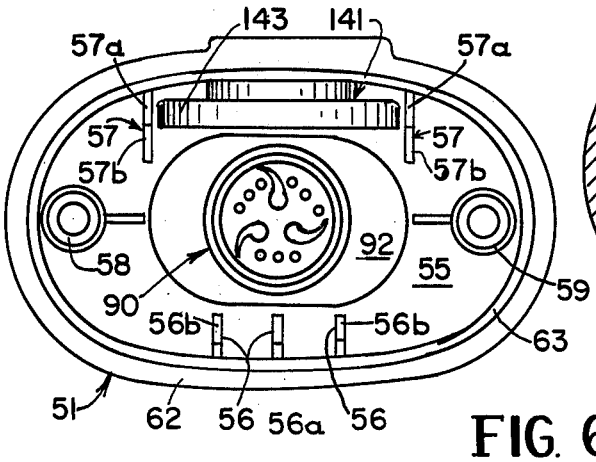
FIG. 3 is an enlarged plan view of the spray head with the cover removed showing the relationship of the pulsating spray generator and the actuating knob of the control mechanism.

Referring now to the drawings and more particularly to FIGS. 1, 3, 10, 11 and 12, there is disclosed a spray apparatus 50 of the present invention including a housing 51 having a neck 52, the housing 51 being hollow and having formed therein a chamber 55. There are three positioning ribs 56 extending inwardly into the chamber 55 from one side of the housing 51, each of the ribs or guides 56 having a bearing surface thereon **56*a*** adjacent the housing wall and a bearing surface 56*b* away from the housing wall indented below the surfaces 56*a*, all for a purpose hereinafter set forth. On the opposite side of the housing wall 51 there is provided two spaced apart guides or ribs 57 each having a bearing surface 57*a* thereon adjacent to the inner housing wall, and bearing surfaces 57*b* away from the wall. The surfaces 56*a* and 57*a* lie in the same plane and the surfaces 56*b* and 57*b* lie in the same plane toward the rear of the housing 51.

Referring to the spray apparatus 50 in its upright or hand-held position there is provided a top positioning fin 58 accommodating a screw opening and at the bottom of the housing 51 there is provided a bottom positioning fin 59 also accommodating a screw opening therein. Each of the fins 58 and 59 have indented bearing surfaces 58*a* and *b*, and 59*a* and *b*. The front edge of the housing 51 is defined by an elliptical lip 62 adjacent to an outwardly extending flange 63, the flange and the lip 62 and 63 being integrally formed with the housing 51. The bottom positioning fin 59 extends rearwardly into the chamber 55 of the housing 51 and forms a hollow water chamber 65 at the back end of the housing 51, the chamber having provided therein a longitudinally extending tongue 66, for a purpose hereinafter described. In practice the entire housing 51 as described may be molded in a single piece.

Water flowing upwardly through the water chamber 65 into the housing 51 enters a water diverter 70 sealingly positioned in the rear of the housing 51. The diverter 70 includes a cylindrical housing 71 having a closed end cap 72 and spaced apart grooves 73 and 74 (see FIG. 8) into which are positioned two O-rings 76 and 77 respectively. Intermediate the O-rings 76 and 77 are two spaced apart openings 78 in the cylindrical housing 71.

A pulsating spray generator 90 is slidably mounted on the diverter 70, the pulsating spray generator 90 including a cylindrical housing 91 having an internal diameter substantially greater than housing 71 and having an elliptical front wall 92 from which extends a collar 93. A finger 94 extends outwardly from the side wall 91, for a purpose hereinafter set forth. The collar 93 has formed therein a plurality of tapered slots 96 each of the slots being tapered from a narrow opening at the elliptical front wall 92 to a larger opening at the end of the collar 93. A circular front face 97 is located in the center of the elliptical front wall 92 and is provided with three sets of three apertures 98, the apertures being located at approximately 120° intervals.

Situated inside the housing 91 is a turbine 100 having a bladed annular ring 101 integrally formed with a cylindrical body 102 having elongated rectangular slots 103 therein. A hemicylindrical wall 106 extends outwardly from the cylindrical body 102 and is closed with a half circular front wall 104, which front wall accommodates therein a journal 107. As seen from the drawings, and particularly FIG. 11, the turbine 100 is mounted for rotation within the cylindrical housing 91 and particularly in the well 108 receiving the journal 107.

An inner cylinder 115 extends rearwardly in use from the turbine 100 and has a smaller dimension than the cylindrical body 91 but is attached thereto by means of a press fit 116 at the end of the body 91. The inner cylinder 115 may have a central aperture 117 therein in registry with the bladed annular ring 101 of the turbine 100 and also is provided with a plurality of side apertures 118 in the inner cylinder wall 115, thereby to establish a flow path between the diverter 70 and the turbine 100.

Figures 8, 9, 10, 11:
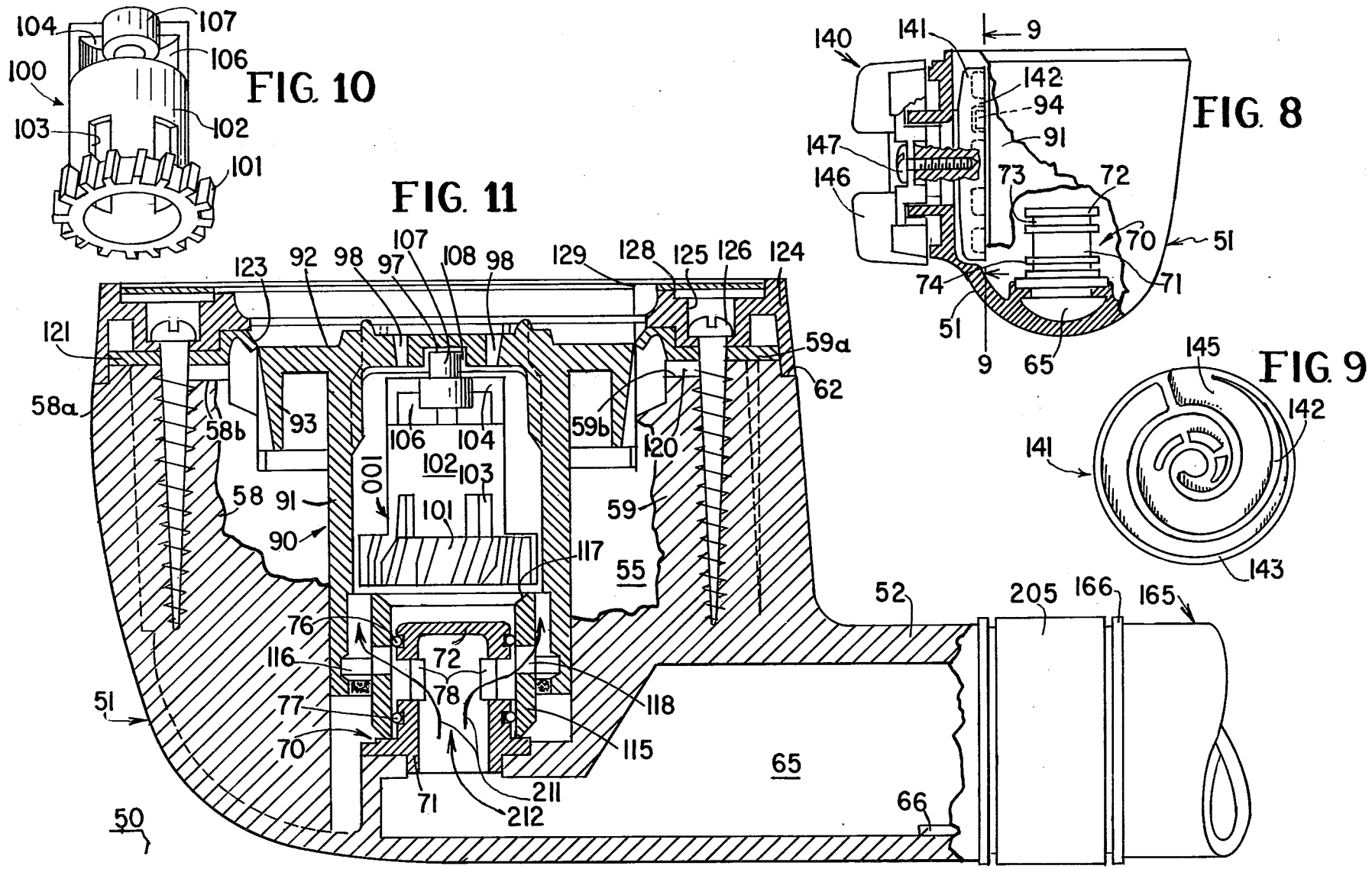
FIG. 8 is an enlarged elevational view partly in section of the device illustrated in FIG. 1 particularly showing the mounting of the actuating knob and cam mechanisms.
FIG. 9 is a view of the device illustrated in FIG. 8 as seen along line 9—9 thereof particularly showing the cam design.
FIG. 10 is an enlarged perspective view of the turbine located inside the pulsating spray generator.
FIG. 11 is an enlarged sectional view of the spray apparatus showing the relationship of the pulsating spray generator and the water diverter wherein the spray generator is in the fully retracted position thereof to provide a pulsating spray only.
Figure 14:
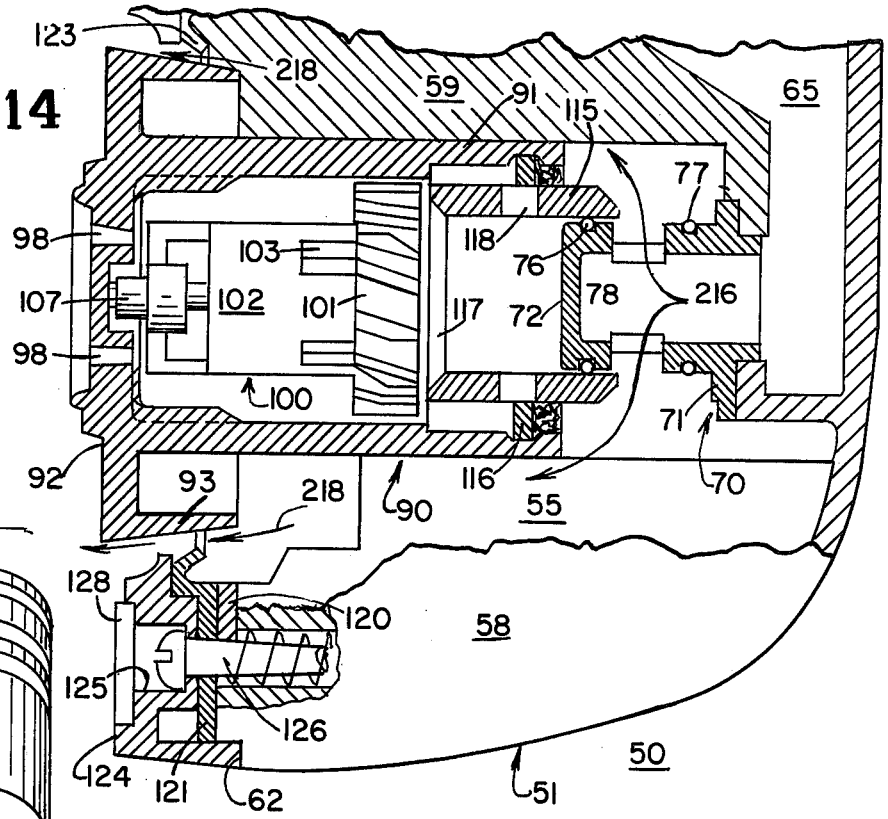
FIG. 14 is an enlarged view similar to FIG. 11 illustrating the pulsating spray generator in the fully extended position thereof to provide a normal spray only.
Figure 13:
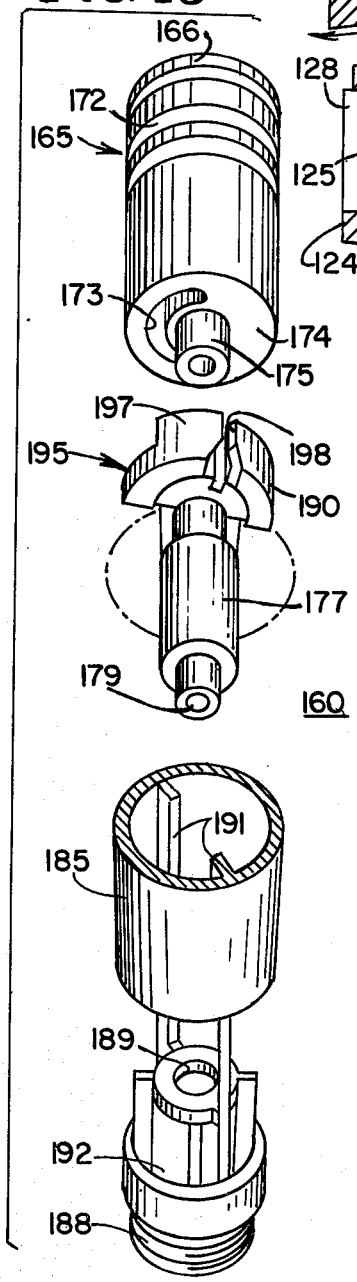
FIG. 13 is an exploded view of the metering device and handle sheath of the present invention.

Referring now to FIGS. 11 and 14, the housing 51 is closed and the chamber 55 made water tight by an elliptical semi-rigid washer 120 placed on the bearing surfaces 58*b*, 59*b* of the fins 58 and 59 respectively and also on the surfaces 56*b* and 57*b* of the guides 56 and 57 respectively. A resilient seal 121 also elliptical in shape and having an inner beveled finger 123 is placed on the semi-rigid washer 120 and rests on the bearing surfaces 58*a* and 59*a* of the fins 58 and 59 respectively as well as on the bearing surfaces 56*a* and 57*a* of the guides or ribs 56 and 57, respectively. A front cover assembly 124 overlies the resilient seal 121 and rests on the elliptical lip 62 of the housing 51 and is maintained in compressed sealing relation with the housing 51 by means of the screws 126. A decorative face plate 128 is also provided.

Figure 12:
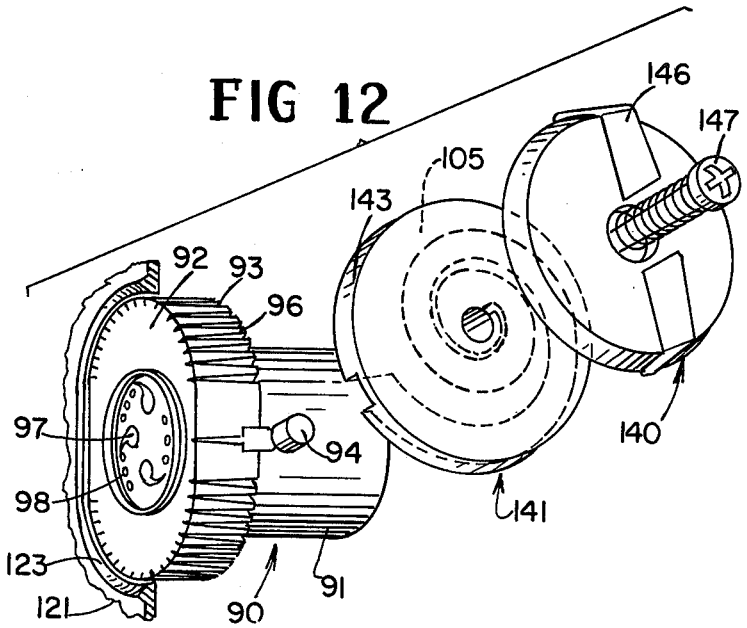
FIG. 12 is an exploded view of the actuating knob selector, cam and pulsating spray generator.

A control knob 140 is operatively associated with the circular cam 141 as best seen in FIGS. 8, 9 and 12. The knob 140 and cam 141 rotate through about 340° to slide the pulsating spray generator 90 from a fully recessed position as shown in FIG. 11 to an extended position as shown in FIG. 14. Movement of the generator 90 is accomplished by actuation of the cam 141 which is provided with an upstanding spiral wall 142 cooperating with a peripheral wall 143 to define a cam path 145. The knob 140 has upstanding wings 146 and is mounted by means of screw 147 to the cam 141 through the side of the housing 51. The finger 94 on the cylindrical housing 91 of the generator 90 fits between the upstanding walls 142 and 143 and follows the defined cam path 145 to effect sliding movement of the generator 90 as the knob 140 is turned.

As best seen in FIGS. 1, 2, 4 to 7 and 13, a metering device 160 is associated with the spray apparatus 50 to control the flow rate or volume of water entering the chamber 55. The metering device 160 includes a hollow tube 165 having an outwardly extending flange 166 and a tubular extension 168 in which is positioned a groove 167 of a size to receive the tongue 66 in the neck 52 as hereinbefore described. The outer surface of the hollow tube 165 is provided with a circular recess 172 for receiving therein O-rings seals (not shown) and at the bottom of the hollow tube 165 is a bottom wall 174 provided with an arcuate port 173 having an angular extent of about 150°. A stab shaft 175 extends away from the bottom wall 174 and has positioned thereon as seen in FIG. 1 a circular disc 178 which has a diameter smaller than the tube 165. Extending outwardly from the stub shaft 175 and beyond the disc 178 is a solid extension member 177 having a threaded aperture 179 in the bottom thereof.

The handle sheath 185 is a tapered hollow tube with a larger chamber 186 and a smaller chamber 187. Extending outwardly away from the smaller chamber 187 is a threaded extension 188 adapted to receive thereon a flexible conduit. An annular flange 189 has an aperture therein and is positioned at the small end of the sheath 185, there being provided water flow paths 192 between the flange 189 and the sheath wall 185. Longitudinally extending ribs 191 are positioned on the inside of the sheath 185 and extend partly therealong, the ribs being spaced 180° from each other.

Figure 4:
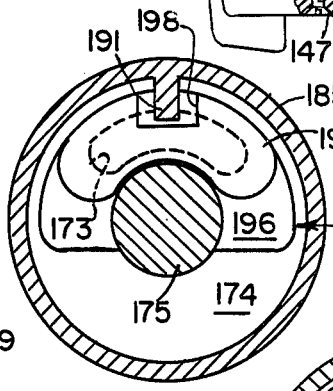
FIG. 4 is a view in section of the device illustrated in FIG. 2 taken along the line 4—4 thereof.
Figure 5:
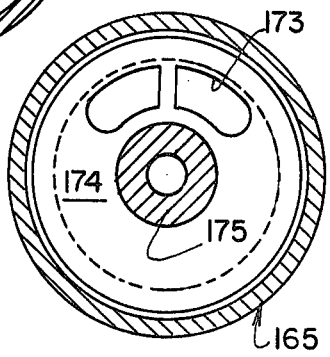
FIG. 5 is a view in section of the device illustrated in FIG. 2 taken along the line 5—5 thereof.
Figure 6:
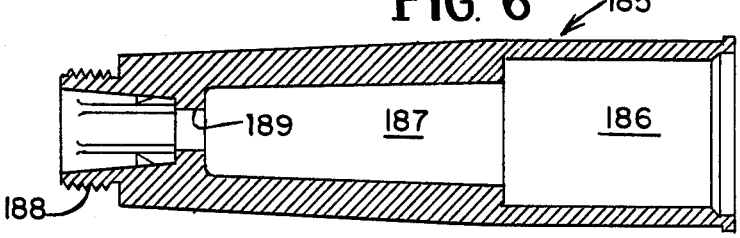
FIG. 6 is a sectional view of the handle sheath of the device shown in FIG. 1.
Figure 7:
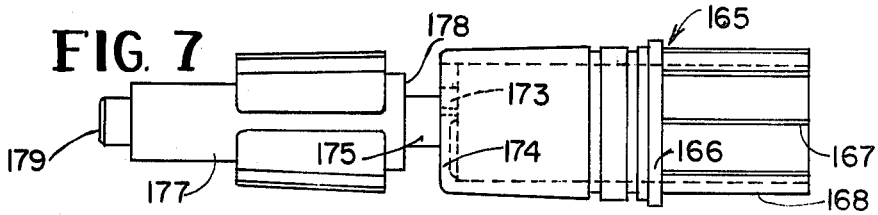
FIG. 7 is a plan view of the metering mechanism of the present invention.

A valve 195 comprised of a suitable plastic material includes a semicircular disc 196 which extends partly around the stub shaft 175 and seats on the surface of disc 178. An upstanding valve seat 197 integral with the disc 196 extends away from the disc in use toward the arcuate port 173, the arcuate extent of the valve seat 197 being greater than arcuate extent of the corresponding port 173, as best seen in FIG. 4. The disc 196 is provided with a groove 198 which receives therein one of the ribs 191 thereby to gang movement of the valve 195 with the handle sheath 185.

A screw 201 mounts the handle sheath 185 to the metering device 160 and more particularly to the extension 177 thereof. A ring 205 is fixedly connected to the housing 51 and covers the extension tube 168 of the metering device 160.

Operation of the apparatus 50 begins with connection of the threaded extension 188 to a flexible conduit (not shown) in communication with a source of pressurized water. Water flows into the device 50 along the paths illustrated by arrows 210 (see FIG. 2) through the sheath 185 to the metering device 160. Since the valve 195 is ganged for rotation with the sheath 185 by means of the tongue or rib 191 and the groove 198, angular rotation of the sheath 185 with respect to the metering tube 165 varies the position of the valve 195 and more particularly the valve seat 197 with respect to the arcuate port 173 in the bottom wall 174 of the tube 165. The tube 165 does not rotate due to the intermeshing of the tongue 66 on the back wall of the neck 52 and the groove 167 in the extension 168 of the tube 165. Rotation of the sheath 185 through an angle of about 150° is sufficient fully to open or close the port 173.

In some jurisdictions it is required by code that a small amount of water be permitted to flow through the shower head apparatus 50 at all times; therefore, in those jurisdictions the surface of the valve seat 197 is distressed so that even in the fully closed position a small amount of water sufficient to meet the code is permitted to enter the port 173.

Water flowing through the metering device 160 enters the water chamber 65 and flows upwardly therethrough as shown by the arrow 212 (see FIG. 11) into the water diverter 70. Referring to FIG. 11 in which the pulsating spray generator 90 is in the fully retracted position, the water flow path 212 continues through the diverter 70 as illustrated by the arrows 211, in which the water flowing into the diverter 70 exits therefrom through the apertures 78 in the side wall 71 and thence through the apertures 118 in the inner cylinder 115. Water flow continues intermediate the walls 91 and 115 through the bladed annular ring 101 of the turbine 100 thereby causing rotation of the turbine about its longitudinal axis. Back flow of water into the chamber 55 is prevented by the mounting 116 and the O-ring 77.

Since only one half of the end portion of the cylinder 106 is open certain of the apertures 98 are shielded from the water flow and thereby the pulsating effect is obtained. Continued rotation of the turbine 100 provides sequential emission of water through each of the three sets of apertures 98. In this position wherein the generator 90 is in the fully retracted position all the water, as shown by the arrows 212 and 214, enters the generator 90 and more particularly enters and flows through the turbine 100 and out through the apertures 98. No water or substantially no water enters the chamber 55 and therefor, there is no appreciable flow through the grooves 96 in the collar 93.

In order to move the generator 90 from its position shown in FIG. 11 that is the fully retracted position wherein all the water flows through the apertures 98 to the position shown in FIG. 14 that is the fully extended position wherein substantially all of the water flows through the grooves 96 and the collar 93 to provide a normal spray of water, actuation of the knob 140 is necessary. Rotation of the knob 140 through an angle of about 340° causes the finger 94 on the cylindrical wall 91 to move forwardly that is from a position near the rear of the housing 51 to a position closer to the front cover assembly 124. The flow path of the water is illustrated in FIG. 14 by the arrows 216 which shows that water flowing upwardly through the chamber 65 into the diverter 70 and outwardly therefrom through the apertures 78 now flows into the chamber 55 in the housing 51. Because of the O-ring 76 in the groove 73 (see FIGS. 8 and 14) a seal is formed between the inner surface of the cylinder 115 and the O-ring 76 thereby preventing water from flowing into the inner cylinder and hence to the turbine 100. Also the mounting 116 of cylinder 115 to the housing 91 prevents any water from entering the turbine 100 via the space between the cylinder 115 and housing 91.

After the water in the chamber 65 flows into the chamber 55 it is directed toward the front cover assembly 124 and escapes from the housing 51 through the grooves 96 in the collar 93. Since the grooves 96 are tapered from the front wall 92 toward the rear of the collar 93, the greatest area for flow is illustrated in FIG. 14 and a normal spray of water will exit from the apparatus 50 as illustrated by the arrows 218. The flow path is through the grooves 96 and between the collar 93 and the adjacent inner edge of the edge 123. Positions intermediate those shown in FIGS. 11 and 14 result in a proportion of water being emitted through both the pulsating spray generator 90 and the grooves 96. Retraction of the generator 90 toward the rear of the housing 51 results in a finer normal spray through the grooves 96, since less effective area is available through which the water can escape. Coincidentally, with rearward movement of the generator 90, a greater portion of the water will enter the turbine 100 and exit through the apertures 98 sequentially thereby to provide a greater pulsating effect.

By adjusting the sheath 185 and the control knob 140 the flow rate of water to the housing 51 is controlled as is the proportion of water directed to the pulsating spray generator 90 and to the normal spray exits 96. Effective control of the sheath 185 and the control knob 140 permits all pulsating spray or no pulsating spray and provides infinite control of the volume of water entering the apparatus 50.

While there has been described what at present is considered to be the preferred embodiment of the present invention, it will be appreciated that various modifications and alterations may be made therein without departing from the true spirit and scope of the invention, and it is intended to cover in the appended claims all such alterations and modifications. While certain materials have been identified in the foregoing specification for the housing, the front cover plate and other items, it will be appreciated that there is wide variety of materials acceptable for use for these items and it is intended to cover in the appended claims all such items of manufacture.

What is claimed is:

1. A hand-held spray apparatus, comprising a shower head housing having a tubular handle connected thereto in fluid communication therewith adapted for connection to a source of pressurized water, said handle having an arcuate opening therein for conducting water from the source thereof to said shower head housing, a stub shaft extending from said opening away from said shower head housing, an arcuate valve mounted on said stub shaft for rotating movement thereabout from a position away from said opening to a position in sealing registry with said opening for selectively communicating pressurized water from the source thereof to said shower head housing to permit the user to regular the flow rate of water entering said shower head housing.

2. The apparatus set forth in claim 1, and further comprising a sleeve mounted on said handle for rotation with respect thereto, said sleeve carrying said valve therewith.

3. The apparatus set forth in claim 2, wherein angular rotation of said sleeve with respect to said handle moves said valve from a position away from said handle opening to a position in registry with said handle opening and in sealing relation thereto.

4. A hand-held spray apparatus, comprising a hollow shower head housing having a tubular handle connected thereto in fluid communication therewith and a front wall forming a chamber, said handle having an arcuate opening for conducting water from the source thereof to said shower head housing, a stub shaft extending from said opening away from said shower head housing, an arcuate valve mounted on said stub shaft for rotating movement thereabout from a position away from said opening to a position in sealing registry with said opening for selectively communicating pressurized water from the source thereof to said shower head housing to permit the user to regulate the flow rate of water entering said shower head housing, a pulsating spray generator slidably positioned within said housing having an inlet end and outlet end, the periphery of said outlet end forming with said front wall a plurality of spray outlets, and slide valve means interconnecting said inlet end of said pulsating spray generator and said handle and said hollow shower head housing chamber for selectively communicating pressurized water from said handle to the housing chamber, the pulsating spray generator or proportionately therebetween.

5. The apparatus set forth in claim 4, wherein pressurized water enters said chamber through a tube having apertures in the side wall thereof, said pulsating spray generator being slidably mounted on said tube for movement therealong between a first position wherein all of the pressurized water exiting said tube enters said generator and exits through said outlet end thereof and a second position wherein all of the pressurized water exiting said tube enters said chamber and exits through said spray outlets.

6. The apparatus set forth in claim 4, wherein sliding movement of said pulsating spray generator outlet end with respect to said front wall varies the effective area of said spray outlets.

7. The apparatus set forth in claim 6, wherein at least some of said spray outlets includes a tapered groove in the periphery of said pulsating spray generator outlet end, sliding movement of said outlet end away from said front wall increasing the effective area of said spray outlets.

8. The apparatus of claim 6, wherein movement of said generator to increase the flow rate of water therethrough simultaneously decreases the water flow rate through said spray outlets while increasing the fineness of said spray outlets by decreasing the effective area thereof.

* * * * *